United States Patent [19]

McKamey et al.

[11] Patent Number: 4,961,903

[45] Date of Patent: Oct. 9, 1990

[54] IRON ALUMINIDE ALLOYS WITH IMPROVED PROPERTIES FOR HIGH TEMPERATURE APPLICATIONS

[75] Inventors: Claudette G. McKamey, Knoxville; Chain T. Liu, Oak Ridge, both of Tenn.

[73] Assignee: Martin Marietta Energy Systems, Inc., Oak Ridge, Tenn.

[21] Appl. No.: 319,771

[22] Filed: Mar. 7, 1989

[51] Int. Cl.[5] ..... C22C 38/06

[52] U.S. Cl. ..... 420/79; 420/81; 420/77

[58] Field of Search ..... 420/77, 79, 81

[56] References Cited

U.S. PATENT DOCUMENTS

| | | | |
|---|---|---|---|
| 1,550,507 | 8/1925 | Cooper | 420/62 |
| 1,990,650 | 2/1935 | Jaeger | 410/79 |
| 3,026,197 | 3/1962 | Scramm | 420/81 |

FOREIGN PATENT DOCUMENTS 53-119721 10/1978 Japan .

OTHER PUBLICATIONS

M. G. Mendiratta, et al, "$DO_3$-Domain Structures in $Fe_3Al$-X Alloys" in High-Temperature Ordered Intermetallic Alloys, MRS Symposia Proc., v. 39, pp. 155-162 (Nov. 26-28, 1984).

M. G. Mendiratta, et al, Tensile Flow & Fracture Behavior of $DO_3$ Fe-25 At. Pct. & Fe-31 At. Pct. Al Alloys Metallurgical Transactions A, vol. 18A, Feb. 1987, 283-291.

C. G. McKamey et al, Effect of Chromium on Room Temperature Ductility & Fracture Mode in $Fe_3Al$, Scripta Metallurgica, vol. 22, pp. 1679-1681 (1988).

C. G. McKamey, et al, Development of Iron Aluminides for Coal Conversion Systems, ORNL Report TM-10793, Jul. 1988.

C. G. McKamey, et al, Evaluation of Mechanical & Metallurgical Properties of $Fe_3Al$-Based Aluminides, ORNL Report TM-10125, Sep. 1986.

C. G. McKamey, et al, The Effect of Molybdenum Addition on Properties of Iron Aluminides, to be published in Metallurgical Transactions (accepted-pub. date unknown).

*Primary Examiner*—Deborah Yee

*Attorney, Agent, or Firm*—James D. Griffin; Bruce M. Winchell

[57] ABSTRACT

An improved iron aluminide alloy of the $DO_3$ type that has increased room temperature ductility and improved high elevated temperature strength. The alloy system further is resistant to corrosive attack in the environments of advanced energy corrosion systems such as those using fossil fuels. The resultant alloy is relatively inexpensive as contrasted to nickel based and high nickel steels currently utilized for structural components. The alloy system consists essentially of 26-30 at. % aluminum, 0.5-10 at. % chromium, 0.02-0.3 at. % boron plus carbon, up to 2 at. % molybdenum, up to 1 at. % niobium, up to 0.5 at. % zirconium, up to 0.1 at. % yttrium, up to 0.5 at. % vanadium and the balance iron.

25 Claims, 3 Drawing Sheets

IRON ALUMINIDE ALLOYS WITH IMPROVED PROPERTIES FOR HIGH TEMPERATURE APPLICATIONS

The U. S. Government has rights in this invention pursuant to contract No. DE-AC05-840R21400 awarded by U. S. Department of Energy contract with Martin Marietta Energy Systems, Inc.

TECHNICAL FIELD

This invention relates generally to aluminum containing iron base alloys of the $DO_3$ type, and more particularly to alloys of this type having room temperature ductility, elevated temperature strength, and corrosion resistance, as obtained by the additions of various alloying constituents to the iron aluminide base alloy.

BACKGROUND ART

Currently, most heat-resistant alloys utilized in industry are either nickel-based alloys or steels with high nickel content (e.g., austenitic steels). These contain a delicate balance of various alloying elements, such as chromium, cobalt, niobium, tantalum and tungsten, to produce a combination of high temperature strength, ductility and resistance to attack in the environment of use. These alloying elements also affect the fabricability of components, and their thermal stability during use. Although such alloys have been used extensively in past, they do not meet the requirements for use in components such as those in advanced fossil energy conversion systems. The main disadvantages are the high material costs, their susceptibility to aging embrittlement, and their catastrophic hot corrosion in sulfur-containing environments.

In contrast, binary iron aluminide alloys near the $Fe_3Al$ composition have certain characteristics that are attractive for their use in such applications. This is because of their resistance to the formation of low melting eutectics and their ability to form a protective aluminum oxide film at very low oxygen partial pressures. This oxide coating will resist the attack by the sulfur-containing substances. However, the very low room temperature ductility (e.g., 1-2%) and poor strength above about 600 degrees C are detrimental for this application. The room temperature ductility can be increased by producing the iron aluminides via the hot extrusion of rapidly solidified powders; however, this method of fabrication is expensive and causes deterioration of other properties. The creep strength of the alloys is comparable to a 0.15% carbon steel at 550 degrees C; however, this would not be adequate for many industrial applications.

Considerable research has been conducted on the iron aluminides to study the effect of compositions to improve the properties thereof for a wider range of applications. Typical of this research is reported in U.S. Pat. No. 1,550,508 issued to H. S. Cooper on Aug. 18, 1925. Reported therein are iron aluminides wherein the aluminum is 10-16%, and the composition includes 10% manganese and 5-10% chromium. Other work is reported in U.S. Pat. No. 1,990,650 issued to H. Jaeger on Feb. 12, 1935, in which are reported iron aluminide alloys having 16-20% Al, 5-8.5% Cr, 0.4-1.5% Mn, up to 0.25% Si, 0.1-1.5% Mo and 0.1-0.5% Ti. Another patent in the field is U.S. Pat. No. 3,026,197 issued to J. H. Schramm on Mar. 20, 1962. This describes iron aluminide alloys having 6-18% Al, up to 5.86% Cr, 0.05-0.5% Zr and 0.01-0.1%B. (These two references do not specify wt% or at.%.) A Japanese Pat. (No. 53119721) in this field was issued on Oct. 19, 1978, to the Hitachi Metal Company. This describes iron aluminide alloys, for use in magnetic heads, in wt% of 1.5-17% Al, 0.2-15% Cr and 0.1-8% of "alloying" elements selected from Si, Mo, W, Ti, Ge, Cu, V, Mn, Nb, Ta, Ni, Co, Sn, Sb, Be, Hf, Zr, Pb, and rare earth metals.

Two typical articles in the technical literature regarding the iron aluminide research are "$DO_3$-Domain Structures in $Fe_3Al$-X Alloys" as reported by Mendiratta, et al., in High Temperature Ordered Alloys, Materials Research Society Symposia Proceedings, Volume 39 (1985), wherein various ternary alloy studies were reported involving the individual addition of Ti, Cr, Mn, Ni, Mo and Si to the $Fe_3Al$. The second, by the same researchers, is "Tensile Flow and Fracture Behavior of $DO_3$ Fe-25 At.% Al and Fe-31 At.% Al Alloys", Metallurgical Transactions A, Volume 18A, Feb. 1987.

Although this research had demonstrated certain property improvements over the $Fe_3Al$ base alloy, considerable further improvement appeared necessary to provide a suitable high temperature alloy for many applications. For example, no significant improvements in room temperature ductility or high temperature (above 500 degrees C) strength have been reported. These properties are especially important if the alloys are to be considered for engineering applications. It should also be noted that additives in the form of other elements may improve one property but be deleterious to another property. For example, an element which may improve the high temperature strength may decrease the alloy's susceptability to corrosive attack in sulfur-bearing environments.

Accordingly, it is an object of the present invention to provide an alloy having a composition near $Fe_3Al$ that has improved room temperature ductility.

It is another object to provide such an alloy that has sufficient strength at high temperatures so as to be useful for structural components.

Another object is to provide such an alloy that is resistant to deleterious attack in environments containing sulfur compounds.

A further object is to provide such an alloy that is resistant to aging embrittlement..

These and other objects of the present invention will become more apparent upon a consideration of the full description of the invention as set forth hereinafter.

DISCLOSURE OF THE INVENTION

In accordance with the present invention, there is provided a composite alloy having a composition near $Fe_3Al$ but with selected additions of chromium, molybdenum, niobium, zirconium, vanadium, boron, carbon and yttrium. The optimum composition range of this improved alloy is, in atomic percent, Fe-(26-30)Al-(0.5-10) Cr-(up to 2.0)Mo -(up to 1)Nb-(up to 0.5)Zr-(0.02-0.3)B and/or C- (up to 0.5)V-(up to 0.1)Y. Alloys within these composition ranges have demonstrated room temperature ductility up to about 10% elongation with yield and ultimate strengths at 600 degrees C. at least comparable to those of modified chromium-molybdenum steel and Type 316 stainless steel. The oxidation resistance is far superior to that of the Type 316 stainless steel.

BEST MODE FOR CARRYING OUT THE INVENTION

A group of test alloy samples were prepared by arc melting and then drop casting pure elements in selected proportions which provided the desired alloy compositions. This included the preparation of an Fe-28 at.% Al alloy for comparison. The alloy ingots were homogenized at 1000 degrees C. and fabricated into sheet by hot rolling, beginning at 1000 degrees C. and ending at 650 degrees C., followed by final warm rolling at 600 degrees C. to produce a cold-worked structure. The rolled sheets were typically 0.76mm thick. All alloys were then given a heat treatment of one hour at 850 degrees C. and 1–7 days at 500 degrees C.

The following Table I lists specifics of the test alloys giving their alloy identification number. The total amount of the additives to the Fe-28Al base composition (FA-61) range from about 2 to about 14 atomic percent.

Figure 1:
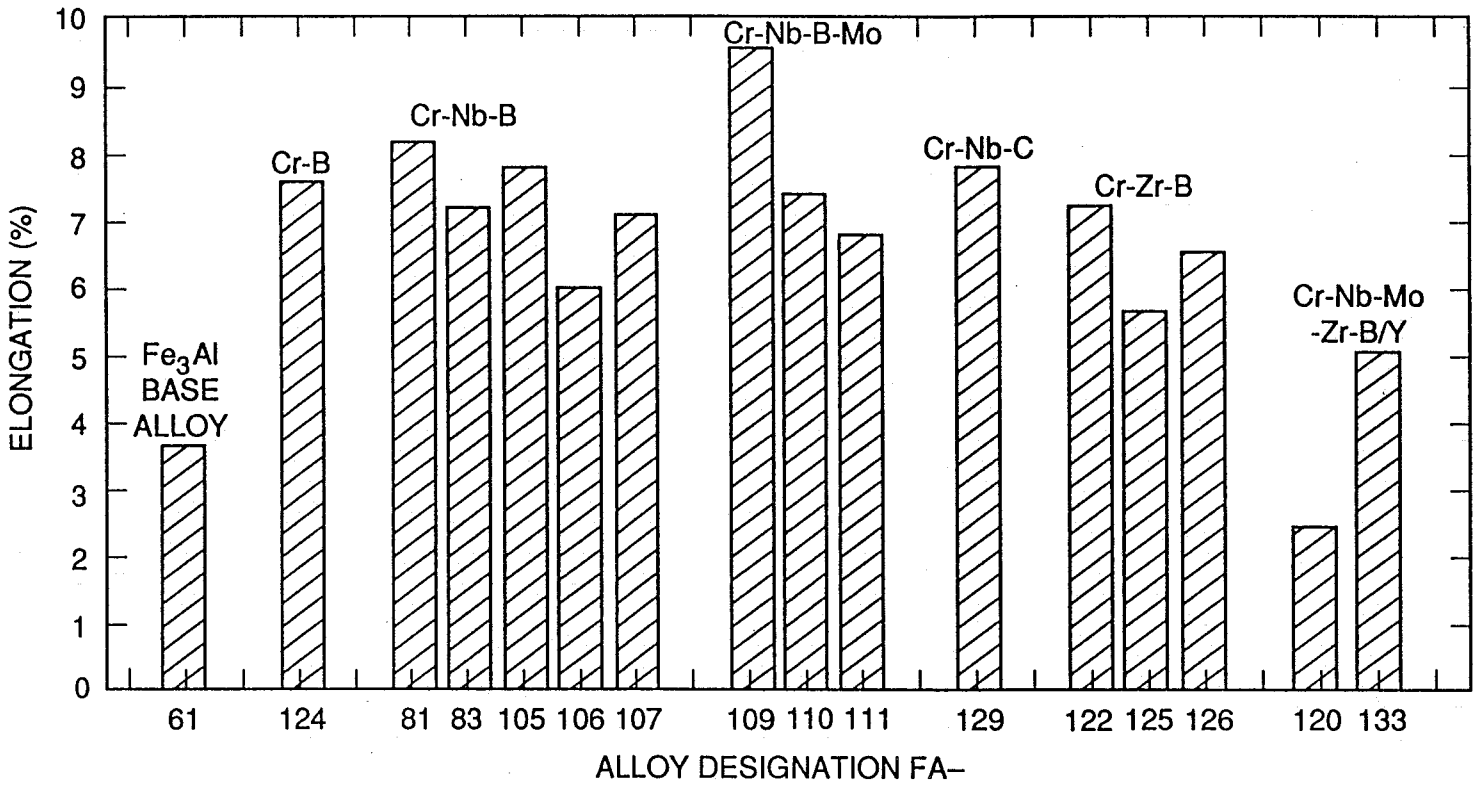
FIG. 1 is a graph comparing the room temperature ductility of several alloys of the present invention as compared to that of the $Fe_3Al$ base alloy.
Figure 2:
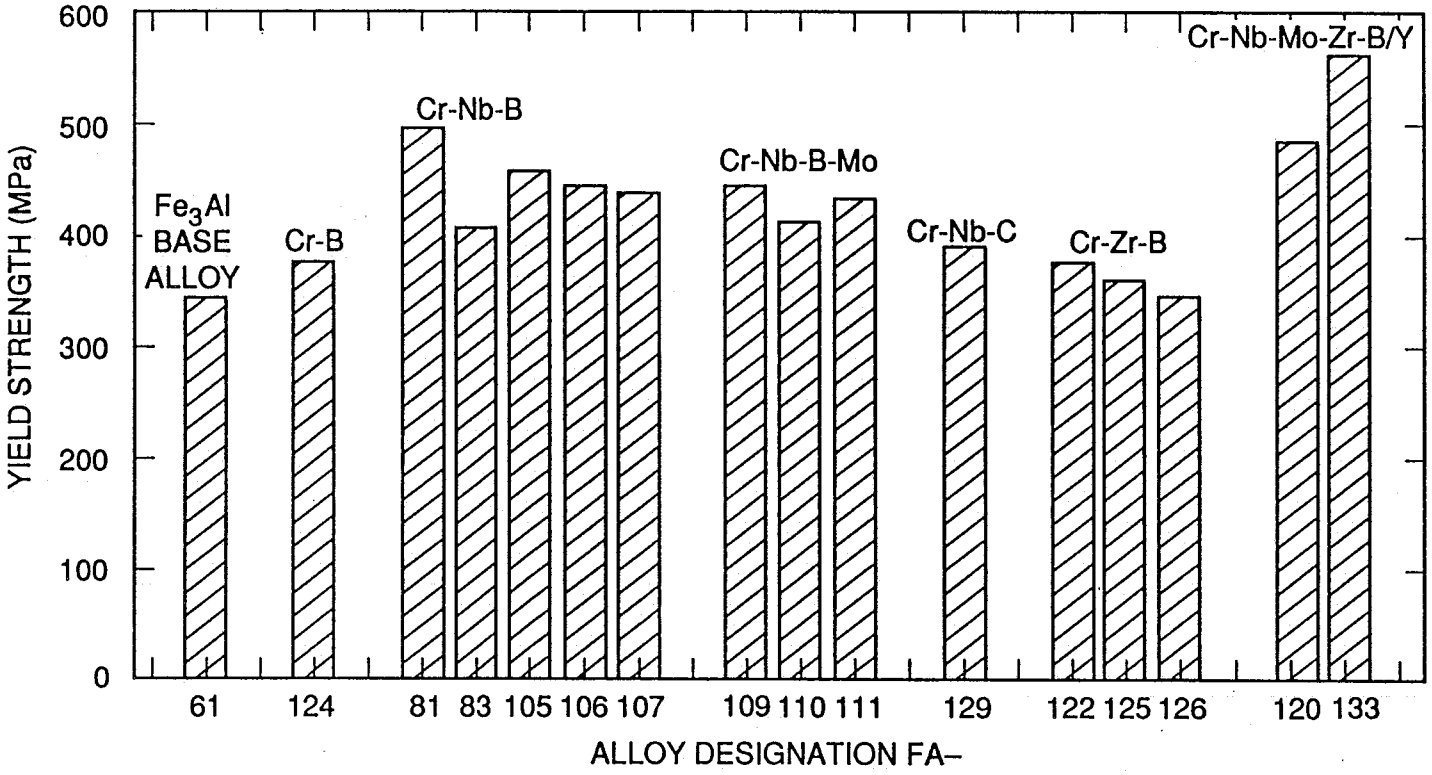
FIG. 2 is a graph comparing the yield strenth at 600 degrees C. of several alloys of the present invention as compared to the base alloy.

The effect of these additions upon the tensile properties at room temperature and at 600 degrees C. were investigated. The results of these tests with certain of the alloy compositions are illustrated in FIGS. 1 and 2, respectively. In each case, the results are compared with the $Fe_3Al$ base alloy (Alloy Number FA-61). It can be seen that several of the alloy compositions demonstrate substantially improved room temperature ductility over the base alloy, and at least comparable yield strength at the elevated temperature. Tests of alloys with individual additives indicated that improvements in strength at both room temperature and at 600 degrees C. are obtained from molybdenum, zirconium or niobium; however, these additives decrease the room temperature ductility. Of these additives, only the Mo produces significant increases in creep rupture life as indicated in Table II. The alloys are very weak in creep without molybdenum, but with molybdenum they have rupture lives of up to 200 hours, which is equivalent to some austenitic stainless steels. Only the chromium produces a substantial increase in room temperature ductility.

Figure 3:
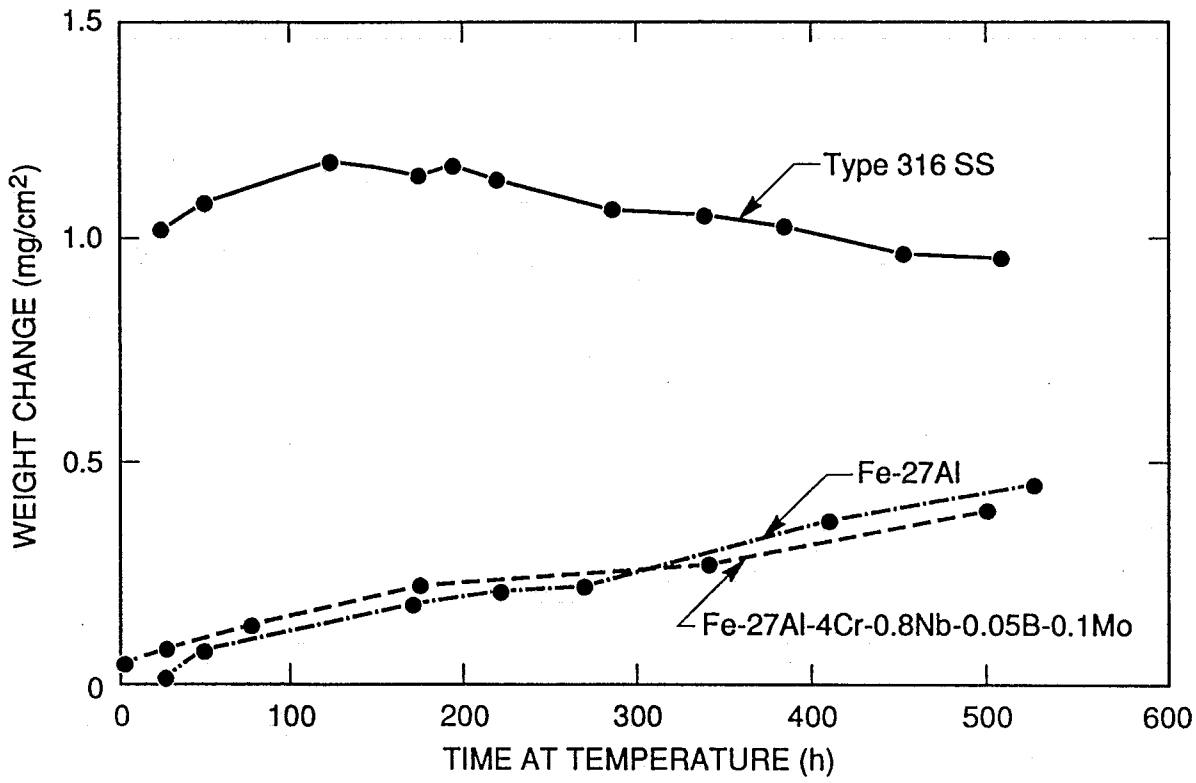
FIG. 3 is a graph illustrating the oxidation resistance of one of the alloys of the present invention at 800 degrees C as compared to that of Type 316 stainless steel and the base alloy of Fe-27Al.

Tests of the oxidation resistance in air at 800 degrees C. and 1000 degrees C. were conducted for several of the alloys. The results are presented in the following Table III where they are compared to data for Type 316 stainless steel. In alloys where there was a tendency for the oxide coating to spall, spalling was substantially prevented when niobium or yttrium was incorporated into the alloy. The oxidation resistance for one of the alloys (FA-109) at 800 degrees C. is illustrated in FIG. 3 where it is compared to Type 316 stainless steel and the base alloy, Fe-27% Al. The loss in weight of 316 stainless steel after almost 100 h oxidation is due to spalling of oxide scales from specimen surfaces.

The tensile properties of a group of the alloys of the present invention were determined. The results are presented in the following Table IV. These data indicate that the aluminum composition can be as low as 26 atomic percent without significant loss of ductility. Also, the data indicate that additions of up to about 0.5 atomic percent Mo can be used and still retain at least 7% ductility.

Table V presents a comparison of the room temperature and 600 degree C. tensile properties of modified 9Cr-lMo and type 316 SS with selected iron aluminides, including the base alloy. It is noted that the iron aluminides are much stronger at 600 degrees C. than either of these two widely used alloys. At room temperature, while the yield strengths of the iron aluminides are better than type 316 SS, ultimate strengths are comparable for all alloys. The room temperature ductilities of the modified iron aluminides are within a usable range.

On the basis of the studies conducted on the various iron aluminide alloys, an optimum composition range for a superior alloy which gives the best compromise between ductility strength and corrosion resistance has been determined. This iron aluminide consists essentially of 26–30 atomic percent aluminum, 0.5–10 atomic percent chromium, and about 0.3 to about 5 atomic percent additive selected from molybdenum niobium, zirconium, boron, carbon, vanadium, yttrium and mixtures thereof, the remainder being iron. More specifically, an improved iron aluminide is provided by a composition that consists essentially of Fe-(26-30)Al-(0.5-10)Cr- (up to 2.0)Mo-(up to 1)Nb-(up to 0.5)Zr-(0.02-0.3) B and/or C-(up to 0.5)V-(up to 0.1)Y, where these are expressed as atomic percent. A group of preferred alloys within this composition range consists essentially of about 26–30 at.% Al, 1–10 at.% Cr, 0.5 at.% Mo, 0.5 at.% Nb, 0.2 at.% Zr, 0.2 at.% B and/or C and 0.05 at.% yttrium.

From the foregoing, it will be understood by those versed in the art that an iron aluminide alloy of superior properties for structural materials has been developed. In particular, the alloy system exhibits increased room temperature ductility, resistance to corrosion in oxidizing and sulfur-bearing environments and elevated temperature strength comparable to prior structural materials. Thus, the alloys of this system are deemed to be applicable for advanced energy conversion systems. Although specific alloy compositions are given for illustration purposes, these are not intended as a limitation to the present invention. Rather, the invention is to be limited only by the appended claims and their equivalents when read together with the complete description.

TABLE I

| ALLOY NO. | ATOMIC PERCENT | WEIGHT PERCENT |
|---|---|---|
| FA-61 | Fe-28Al (Base Alloy) | Fe-15.8Al |
| FA-80 | Fe-28Al-4Cr-1Nb-0.05B | Fe-15.8Al-4.3Cr-1.9Nb-0.01B |
| FA-81 | Fe-26Al-4Cr-1Nb-0.05B | Fe-14.4Al-4.3Cr-1.9Nb-0.01B |
| FA-82 | Fe-24Al-4Cr-1Nb-0.05B | Fe-13.2Al-4.2Cr-1.9Nb-0.01B |
| FA-83 | Fe-28Al-4Cr-0.5Nb-0.05B | Fe-15.8Al-4.4Cr-1Nb-0.01B |
| FA-84 | Fe-28Al-2Cr-0.05B | Fe-15.9Al-2.2Cr-0.01B |

TABLE I-continued

| ALLOY NO. | ATOMIC PERCENT | WEIGHT PERCENT |
|---|---|---|
| FA-85 | Fe-28Al-2Cr-2Mo-0.05B | Fe-15.6Al-2.1Cr-4Mo-0.01B |
| FA-86 | Fe-28Al-2Cr-1Mo-0.05B | Fe-15.7Al-2.2Cr-2Mo-0.01B |
| FA-87 | Fe-26Al-2Cr-1Nb-0.05B | Fe-14.4Al-2.1Cr-1.9Nb-0.01B |
| FA-88 | Fe-28Al-2Mo-0.1Zr-0.2C | Fe-15.6Al-4Mo-0.2Zr-0.5C |
| FA-89 | Fe-28Al-4Cr-0.1Zr | Fe-15.9Al-4.4Cr-0.2Zr |
| FA-90 | Fe-28Al-4Cr-0.1Zr-0.2B | Fe-15.9Al-4.4Cr-0.2Zr-0.05B |
| FA-93 | Fe-26Al-4Cr-1Nb-0.1Zr | Fe-14.4Al-4.3Cr-1.9Nb-0.2Zr |
| FA-94 | Fe-26Al-4Cr-1Nb -0.1Zr-0.2B | Fe-14.5Al-4.3Cr-1.9Nb -0.2Zr-0.04B |
| FA-95 | Fe-28Al-2Cr-2Mo -0.1Zr-0.2B | Fe-15.6Al-2.1Cr-4Mo 0.2Zr-0.04B |
| FA-96 | Fe-28Al-2Cr-2Mo -0.5Nb-0.05B | Fe-15.5Al-2.1Cr-4Mo -1Nb-0.01B |
| FA-97 | Fe-28Al-2Cr-2Mo-0.5Nb -0.1Zr-0.2B | Fe-15.5Al-2.1Cr-4Mo -1Nb-0.04B |
| FA-98 | Fe-28Al-4Cr-0.03Y | Fe-15.9Al-4.4Cr-0.06Y |
| FA-99 | Fe-28Al-4Cr-0.1Zr-0.05B | Fe-15.9Al-4.4Cr-0.2Zr-0.01B |
| FA-100 | Fe-28Al-4Cr-0.1Zr-0.1B | Fe-15.9Al-4.4Cr-0.2Zr-0.02B |
| FA-101 | Fe-28Al-4Cr-0.1Zr-0.15B | Fe-15.9Al-4.4Cr-0.2Zr-0.03B |
| FA-103 | Fe-28Al-4Cr-0.2Zr-0.1B | Fe-15.9Al-4.4Cr-0.4Zr-0.02B |
| FA-104 | Fe-28Al-4Cr-0.1Zr-0.1B -0.03Y | Fe-15.9Al-4/4Cr-0.2Zr-0.02B -0.06Y |
| FA-105 | Fe-27Al-4Cr-0.8Nb | Fe-15.1Al-4.3Cr-1.5Nb |
| FA-106 | Fe-27Al-4Cr-0.8Nb-0.1B | Fe-15.1Al-4.3Cr-1.5Nb-0.02B |
| FA-107 | Fe-26Al-4Cr-0.5Nb-0.05B | Fe-14.5Al-4.3Cr-1Nb-0.01B |
| FA-108 | Fe-27A;-4Cr-0.8Nb-0.05B | Fe-15.1Al-4.3Cr-1.5Nb-0.01B |
| FA-109 | Fe-27Al-4Cr-0.8Nb-0.05B -0.1Mo | Fe-15.1Al-4.3Cr-1.5Nb-0.01B -0.2Mo |
| FA-110 | Fe-27Al-4Cr-0.8Nb-0.05B -0.3Mo | Fe-15.1Al-4.3Cr-1.5Nb-0.01B -0.6Mo |
| FA-111 | Fe-27Al-4Cr-0.8Nb-0.05B -0.5Mo | Fe-15.1Al-4.3Cr-1.5Nb-0.01B -1Mo |
| FA-115 | Fe-27Al-10Cr-0.5Nb-0.5Mo -0.1Zr-0.05B-0.02Y | Fe-15.2Al-10.8Cr-1.0Nb-1.0Mo -0.2Zr-0.01B-0.04Y |
| FA-116 | Fe-27Al-1Cr-0.5Nb-0.05Mo -0.1Zr-0.05B-0.02Y | Fe-15.0Al-1.1Cr-1.0Nb-1.0Mo -0.2Zr-0.01B-0.04Y |
| FA-117 | Fe-28Al-2Cr-0.8Nb-0.5Mo -0.1Zr-0.05B-0.03Y | Fe-15.7Al-2.2Cr-1.5Nb-1.0Mo -0.2Zr-0.01B-0.06Y |
| FA-118 | Fe-30Al-2Cr-0.3Nb-0.1Mo -0.1Zr-0.05B-0.03Y | Fe-17.1Al-2.2Cr-0.6Nb-0.2Mo -0.2Zr-0.01B-0.06Y |
| FA-119 | Fe-30Al-10Cr-0.3Nb-0.1Mo -0.1Zr-0.05B-0.03Y | Fe-17.1Al-11.1Cr-0.6Nb-0.2Mo -0.2Zr-0.01B-0.06Y |
| FA-120 | Fe-28Al-2Cr-0.8Nb-0.5Mo -0.1Zr-0.05B-0.03Y | Fe-15.7Al-2.2Cr-1.5Nb-1.0Mo -0.2Zr-0.01B-0.06Y |
| FA-121 | Fe-28Al-4Cr-0.8Nb-0.5Mo -0.1Zr-0.05B-0.03Y | Fe-15.5Al-4.3Cr-1.5Nb-1.0Mo -0.2Zr-0.01B-0.05Y |
| FA-122 | Fe-28Al-5Cr-0.1Zr-0.05B | Fe-15.9Al-5.5Cr-0.2Zr-0.01B |
| FA-123 | Fe-28Al-5Cr-0.5Nb-0.5Mo -0.1Zr-0.05B-0.02Y | Fe-15.7Al-5.4Cr-1.0Nb-1.0Mo -0.2Zr-0.01B-0.04Y |
| FA-124 | Fe-28Al-5Cr-0.05B | Fe-15.9Al-5.5Cr-0.01B |
| FA-125 | Fe-28Al-5Cr-0.1Zr-0.1B | Fe-15.9Al-5.5Cr-0.2Zr-0.02B |
| FA-126 | Fe-28Al-5Cr-0.1Zr-0.2B | Fe-15.0Al-5.5Cr-0.2Zr-0.04B |
| FA-127 | Fe-28Al-5Cr-0.5Nb | Fe-15.8Al-5.4Cr-1.0Nb |
| FA-128 | Fe-28Al-5Cr-0.5Nb-0.05B | Fe-15.8Al-5.4Cr-1.0Nb-0.01B |
| FA-129 | Fe-28Al-5Cr-0.5Nb-0.2C | Fe-15.8Al-5.4Cr-1.0Nb-0.05C |
| FA-130 | Fe-28Al-5Cr-0.5Nb-0.5Mo -0.1Zr-0.05B | Fe-15.7Al-5.4Cr-1.0Nb-1.0Mo -0.2Zr-0.01B |
| FA-131 | Fe-28Al-5Cr-0.5Nb-0.5Mo -0.05B | Fe-15.8Al-5.4Cr-1.0Nb-1.0Mo -0.01B |
| FA-132 | Fe-28Al-5Cr-0.5Nb-0.5Mo -0.05B-0.02Y | Fe-15.8Al-5.4Cr-1.0Nb-1.0Mo -0.01B-0.04Y |
| FA-133 | Fe-28Al-5Cr-0.5Nb-0.5Mo -0.1Zr-0.2B | Fe-15.8Al-5.4Cr-1.0Nb-1.0Mo -0.2Zr-0.04B |
| FA-134 | Fe-28Al-5Cr-0.5Nb-0.5Mo | Fe-15.8Al-5.4Cr-1.0Nb-0.6Mo |
| FA-135 | Fe-28Al-2Cr-0.5Nb-0.05B | Fe-15.8Al-2.2Cr-1.0Nb-0.01B |
| FA-136 | Fe-28Al-2Cr-0.5Nb-0.2C | Fe-15.8Al-2.2Cr-1.0Nb-0.05C |
| FA-137 | Fe-27Al-4Cr-0.8Nb-0.1Mo -0.05B-0.1Y | Fe-15.1Al-4.3Cr-1.5Nb-0.2Mo -0.01B-0.2Y |
| FA-138 | Fe-28Al-4Cr-0.5Mo | Fe-15.8Al-4.4Cr-1.0Mo |
| FA-139 | Fe-28Al-4Cr-1.0Mo | Fe-15.7Al-4.3Cr-2.0Mo |
| FA-140 | Fe-28Al-4Cr-2.0Mo | Fe-15.6Al-4.3Cr-4.0Mo |
| FA-141 | Fe-28Al-5Cr-0.5Nb-0.05B -0.2V | Fe-15.8Al-5.4Cr-1.0Nb-0.01B -0.2V |
| FA-142 | Fe-28Al-5Cr-0.5Nb-0.05B -0.5V | Fe-15.8Al-5.4Cr-1.0Nb-0.01B -0.5V |
| FA-143 | Fe-28Al-5Cr-0.5Nb-0.05B -1.0V | Fe-15.8Al-5.5Cr-1.0Nb-0.01B -1.1V |

TABLE 11

Creep properties of iron aluminides at 593 degrees C and 207 Mpa in air

| ALLOY NUMBER | COMPOSITION AT. % | RUPTURE LIFE (H) | ELONGATION (%) |
|---|---|---|---|
| FA-61 | Fe-28Al | 1.6 | 33.6 |
| FA-77 | Fe-28Al-2Cr | 3.6 | 29.2 |
| FA-81 | Fe-26Al-4Cr-1Nb-.05B | 18.8 | 64.5 |
| FA-90 | Fe-28Al-4Cr-.1Zr-.2B | 8.3 | 69.1 |
| FA-98 | Fe-28Al-4Cr-.03Y | 2.7 | 75.6 |
| FA-93 | Fe-26Al-4Cr-1Nb-.1Zr | 28.4 | 47.8 |
| FA-89 | Fe-28Al-4Cr-.1Zr | 28.2 | 42.1 |
| FA-100 | Fe-28Al-4Cr-.1Zr-.1B | 9.6 | 48.2 |
| FA-103 | Fe-28Al-4Cr-.2Zr-.1B | 14.9 | 34.7 |
| FA-105 | Fe-27Al-4Cr-.8Nb | 27.5 | 19.4 |
| FA-108 | Fe-27Al-4Cr-.8Nb-.05B | 51.4 | 72.4 |
| FA-109 | Fe-27Al-4Cr-.8Nb-.05B-.1Mo | 4.6 | 53.7 |
| FA-110 | Fe-27Al-4Cr-.8Nb-.05B-.3Mo | 53.4 | 47.8 |
| FA-111 | Fe-27Al-4Cr-.8Nb-.05B-.5Mo | 114.8 | 66.2 |
| FA-85 | Fe-28Al-2Cr-2Mo-.05B | 128.2 | 28.6 |
| FA-91 | Fe-28Al-2Mo-.1Zr | 204.2 | 63.9 |
| FA-92 | Fe-28Al-2Mo-.1Zr-.2B | 128.1 | 66.7 |

TABLE III

| ALLOY NO. | COMPOSITION (AT. %) | WEIGHT CHANGE AFTER 500 h 800 DEGREES C | 1000 DEGREES C |
|---|---|---|---|
| FA-81 | Fe-26Al-4Cr-1Nb-0.05B | 0.7 | 0.3 |
| FA-83 | Fe-28Al-4Cr-0.5Nb-0.05B | 2.2 | 0.9 |
| FA-90 | Fe-28Al-4Cr-0.1Zr-0.2B | 0.4 | 0.3 |
| FA-91 | Fe-28Al-2Mo-0.1Zr | 0.4 | 0.4 |
| FA-94 | Fe-26Al-4Cr-1Nb-0.1Zr-0.2B | 0.5 | 0.3 |
| FA-97 | Fe-28Al-2Cr-2Mo-0.5Nb -0.1Zr-0.2B | 0.4 | 0.3 |
| FA-98 | Fe-28Al-4Cr-0.03Y | 0.3 | 0.3 |
| FA-100 | Fe-28Al-4Cr-0.1Zr-0.1B | 0.4 | 0.9 |
| FA-104 | Fe-28Al-4Cr-0.1Zr-0.1B-0.03Y | 0.5 | 0.4 |
| FA-108 | Fe-27Al-4Cr-0.8Nb-0.05B | 0.1 | −0.3 |
| FA-109 | Fe-27Al-4Cr-0.8Nb-0.05B-0.1Mo | 0.4 | 0.8 |
| Type 316 SS | | 1.0 | −151.7* |

*Spalls badly above 800 degrees C

TABLE IV

| ALLOY NO. | COMPOSITION (AT. %) | YIELD (MPa) | ELONGATION (%) |
|---|---|---|---|
| FA-81 | Fe-26Al-4Cr-1Nb-0.05B | 347 | 8.2 |
| FA-83 | Fe-28Al-4Cr-0.5Nb-0.05B | 294 | 7.2 |
| FA-105 | Fe-27Al-4Cr-0.8Nb | 309 | 7.8 |
| FA-106 | Fe-27Al-4Cr-0.8Nb-0.1B | 328 | 6.0 |
| FA-107 | Fe-26Al-4Cr-0.5Nb-0.05B | 311 | 7.1 |

TABLE IV-continued

| ALLOY NO. | COMPOSITION (AT. %) | YIELD (MPa) | ELONGATION (%) |
|---|---|---|---|
| FA-109 | Fe-27Al-4Cr-0.8Nb-0.05B-0.1Mo | 274 | 9.6 |
| FA-110 | Fe-27Al-4Cr-0.8Nb-0.05B-0.3Mo | 330 | 7.4 |
| FA-111 | Fe-27Al-4Cr-0.8Nb-0.05B-0.5Mo | 335 | 6.8 |
| FA-120 | Fe-28Al-2Cr-0.8Nb-0.5Mo-0.1Zr-0.05B-0.03Y | 443 | 2.4 |
| FA-122 | Fe-28Al-5Cr-0.1Zr-0.05B | 312 | 7.2 |
| FA-124 | Fe-28Al-5Cr-0.05B | 256 | 7.6 |
| FA-125 | Fe-28Al-5Cr-0.1Zr-0.1B | 312 | 5.6 |
| FA-126 | Fe-28Al-5Cr-0.1Zr-0.2B | 312 | 6.5 |
| FA-129 | Fe-28Al-5Cr-0.5Nb-0.2C | 320 | 7.8 |
| FA-133 | Fe-28Al-5Cr-0.5Nb-0.5Mo -0.1Zr-0.2B | 379 | 5.0 |

TABLE V

| ALLOY COMPOSITION | ROOM TEMPERATURE YIELD (MPa) | ULTIMATE (MPa) | ELONGATION (%) | 600 DEGREES C YIELD (MPa) | ULTIMATE (MPa) | ELONGATION (%) |
|---|---|---|---|---|---|---|
| Modified 9Cr-1Mo | 546 | 682 | 26.0 | 279 | 323 | 32 |
| Type 316 SS | 258 | 599 | 75.0 | 139 | 402 | 51 |
| FA-61 (Fe-28Al) | 279 | 514 | 3.7 | 345 | 383 | 33 |
| FA-81 (Fe-26Al-4Cr-1Nb-.5B) | 388 | 842 | 8.3 | 498 | 514 | 33 |
| FA-90 (Fe-28Al-4Cr-.1Zr-.2B) | 281 | 567 | 7.5 | 377 | 433 | 36 |
| FA-109 (Fe-27Al-4Cr-.8Nb .05B-.1Mo) | 272 | 687 | 9.6 | 446 | 490 | 38 |
| FA-120 | 443 | 604 | 2.4 | 485 | 524 | 34 |
| FA-129 | 320 | 679 | 7.8 | 388 | 438 | 41 |
| FA-133 | 379 | 630 | 5.0 | 561 | 596 | 33 |
| FA-134 | 297 | 516 | 5.3 | 523 | 552 | 25 |

120 = Fe-28Al-2Cr-0.8Nb-0.5Mo-0.1Zr-0.05B-0.03Y
129 = Fe-28Al-5Cr-0.5Nb-0.2C
133 = Fe-28Al-5Cr-0.5Nb-0.5Mo-0.1Zr-0.2B
134 = Fe-28Al-5Cr-0.5Nb-0.5Mo

We claim:

1. An alloy of the $DO_3$ type consisting essentially of 26–30 at.% aluminum, 0.5–10 at.% chromium, 0.02–0.3 at.% boron and the balance iron.

2. The alloy of claim 1 wherein carbon is substituted for at least a portion of said boron.

3. The alloy of claim 2 further consisting essentially of up to 2 at.% molybdenum.

4. The alloy of claim 3 further consisting essentially of up to 1 at.% niobium.

5. The alloy of claim 3 further consisting essentially of up to 0.5 at.% zirconium.

6. The alloy of claim 3 further consisting essentially of up to 0.5 at.% vanadium.

7. The alloy of claim 3 further consisting essentially of up to 0.1 at.% yttrium.

8. The alloy of claim 2 further consisting essentially of up to 1 at.% niobium.

9. The alloy of claim 8 further consisting essentially of up to 0.5 at.% zirconium.

10. The alloy of claim 2 further consisting essentially of up to 0.5 at.% zirconium.

11. An alloy of the $DO_3$ type consisting essentially of 26–30 at.% aluminium, 0.5–10 at.% chromium, 0.02–0.3 at.% carbon and the balance iron.

12. The alloy of claim 11 further consisting essentially of up to 1 at.% niobium.

13. The alloy of claim 12 further consisting essentially of up to 0.5 at.% zirconium.

14. The alloy of claim 11 further consisting essentially of up to 2 at.% molybdenum.

15. The alloy of claim 14 further consisting essentially of up to 0.1 at.% yttrium.

16. An alloy of the $DO_3$ type consisting essentially of 26–30 at.% aluminum, 0.5–10 at.% chromium, 0.1–2.0 at.% molybdenum, 0.02–0.3 at.% boron plus carbon, and the balance iron.

17. The alloy of claim 16 further consisting essentially of up to 1 at.% niobium.

18. The alloy of claim 16 further consisting essentially of up to 0.5 at.% zirconium.

19. The alloy of claim 16 further consisting essentially of up to 0.5 at vanadium.

20. The alloy of claim 16 further consisting essentially of up to 0.1 at.% yttrium.

21. An alloy of the $DO_3$ type consisting essentially of 26–30 at.% aluminum, 0.5–10 at.% chromium, 0.1–2.0 at.% molybdenum, 0.02–0.3 at.% boron plus carbon, up to 1.0 at.% niobium, up to 0.5 at.% zirconium and the balance iron.

22. The alloy of claim 21 consisting essentially of 26–30 at.% aluminum, 0.5–10 at.% chromium, 0.1–2.0 at.% molybdenum, 0.3 at.% boron plus carbon, 0.1 at.% yttrium and the balance iron.

23. The alloy of claim 21 further consisting essentially of up to 0.1 at.% yttrium.

24. The alloy of claim 21 further consisting essentially of up to 0.5 at.% vanadium.

25. An alloy of the $DO_3$ type consisting essentially of 26–30 at.% aluminium, 0.5–10 at.% chromium, 0.1–2.0 at.% molybdenum, 0.02–0.3 at.% carbon, up to 1.0 at.% niobium, up to 0.5 at.% zirconium, up to 0.1 at.% yttrium, up to 0.5 at.% vanadium and the balance iron.

* * * * *